US005232789A

United States Patent [19]

Platz et al.

[11] Patent Number: 5,232,789

[45] Date of Patent: Aug. 3, 1993

[54] STRUCTURAL COMPONENT WITH A PROTECTIVE COATING HAVING A NICKEL OR COBALT BASIS AND METHOD FOR MAKING SUCH A COATING

[75] Inventors: Albin Platz, Ried-Baindlkirch; Klaus Schweitzer, Niederpoecking; Peter Adam, Dachau, all of Fed. Rep. of Germany

[73] Assignee: MTU Motoren- und Turbinen-Union Muenchen GmbH, Munich, Fed. Rep. of Germany

[21] Appl. No.: 845,763

[22] Filed: Mar. 2, 1992

Related U.S. Application Data

[63] Continuation of Ser. No. 489,289, Mar. 5, 1990, abandoned.

[30] Foreign Application Priority Data

Mar. 9, 1989 [DE] Fed. Rep. of Germany ..... 3907625

[51] Int. Cl.[5] ..... B32B 15/01; C22C 1/10; B05D 3/02; F01D 5/28

[52] U.S. Cl. ..... 428/637; 428/678; 428/937; 148/537; 416/241 R; 427/456

[58] Field of Search ..... 428/637, 678, 937, 680, 428/668; 148/127, 902, 527, 537, 516; 427/34, 423, 363.7; 416/241 R

[56] References Cited

U.S. PATENT DOCUMENTS

| | | | |
|---|---|---|---|
| 4,013,424 | 3/1977 | Wildgoose et al. | 428/637 |
| 4,028,787 | 6/1977 | Cretella et al. | 416/241 R |
| 4,050,133 | 9/1977 | Cretella et al. | 427/34 |
| 4,758,480 | 7/1988 | Hecht et al. | 428/937 |
| 4,806,385 | 2/1989 | Timmons | 427/34 |
| 4,808,487 | 2/1989 | Gruenr | 428/637 |
| 4,921,405 | 5/1990 | Wilson | 416/241 R |

*Primary Examiner*—John Zimmerman
*Attorney, Agent, or Firm*—W. G. Fasse

[57] ABSTRACT

A structural component made of a base metal composition on a nickel or cobalt basis is provided with a protective coating against oxidation, corrosion, and thermal fatigue. The protective coating and the base metal are made of chemically the same or identical material, whereby the bonding of the protective coating is increased, the tendency to crack is reduced, and the resistance to thermal fatigue is improved. The grain size of the coating is substantially smaller than the grain size of the base metal composition.

10 Claims, No Drawings

STRUCTURAL COMPONENT WITH A PROTECTIVE COATING HAVING A NICKEL OR COBALT BASIS AND METHOD FOR MAKING SUCH A COATING

This application is a continuation of U.S. patent application Ser. No. 07/489,289, filed on Mar. 5, 1990 now abandoned.

FIELD OF THE INVENTION

The invention relates to a structural component made of a base metal of nickel or cobalt with a protective coating against oxidation, corrosion, and thermal fatigue.

BACKGROUND OF THE INVENTION

High temperature resistant super alloys based on nickel or cobalt have been developed for use in turbine construction. Especially the material of which the blades are made, is exposed to high loads. The material of the blades must not only withstand the high temperatures (above 950° C.) in the turbine, rather, it must also have a high resistance against creeping. In order to assure a high creeping resistance, especially the blade material is grown of super alloys having a macro-crystalline and partially columnar structure by using respective casting and crystallization techniques. During such growing grain boundary precipitants arise of easily oxidizing alloying additives, such as vanadium or titanium, which is disadvantageous to the corrosion resistance. As a result, the surface characteristics, such as oxidation resistance and corrosion resistance, as well as thermal fatigue resistance, deteriorate disadvantageously. Thus, coatings have been developed, such as the MCrAlX, Y-family have been developed (Metal, chromium, aluminum, X=rare earths, Y=yttrium), which improve the surface characteristics due to their high proportion of chromium and aluminum, which, on their part, form stable oxides during the operation of the turbine and which increase the bonding of the oxide layer on the coating surface due to the rare earth metal. Disadvantageous effects are caused by diffusion processes due to the different concentrations on both sides of the boundary layer between the coating surface and the coating, which lead to diffusion pores in the zone near the boundary layer so that the protective coating flakes off when exposed to thermal stress at locations having a high diffusion pore density. Furthermore, the MCrAlX, Y-layers have a tendency to thermal fatigue because between the base metal alloy and the MCrAlYX-layer there is a disproportion in the heat expansion characteristics and the MCrAlX, Y-layers are very ductile compared to the base metal.

Another technically known solution is the formation of chromium and/or aluminum enriched diffusion layers on the surface of the base metal by powder pack cementing and/or gas diffusion coating. Such coatings form oxidation resistant intermetallic phases with the base metal. Due to the higher hardness of these layers with the intermetallic phases, the fatigue strength relative to alternating stress of the structural components is disadvantageously reduced to 30% compared to the fatigue strength without such protective layer. A high micro-crack danger exists for the structural component because the heat expansion characteristic is not adapted to that of the base metal. Such danger increases with an increasing coating thickness. Thus, the coating thickness must be reduced disadvantageously to less than 100μm.

In known coatings, the oxidation and corrosion sensitive components of the base metal, such as vanadium and titanium, are avoided, and stable oxide formers, such as aluminum up to, for example, 20%, and chromium up to, for example, 40% are added to the alloy. In this context the formulation of the composition of the coating becomes evermore extensive and complicated having regard to the cobalt based or nickel based super alloy to be coated in order to overcome bonding problems or to minimize diffusion processes or to build-up protective stable oxides on the surface.

OBJECT OF THE INVENTION

It is the object of the invention to provide a structural component made of a base metal of nickel or cobalt with a protective coating having a higher thermal fatigue resistance, oxidation resistance, and corrosion resistance at temperatures above 800° C., compared to structural components with conventional coatings and which avoids the disadvantages of these coatings and to further provide a method for producing such a structural component.

SUMMARY OF THE INVENTION

The above object is achieved in that the base metal composition and the protective coating composition are both made of a chemically identical material and the protective coating composition of which the entire protective coating is made, is substantially more fine grained than the base metal composition of the structural component.

The invention solves the problems and disadvantages which are present in the prior art by using the material of the base metal for making an identical coating on the surface of the base metal so that diffusion processes are absent and bonding problems with an oxide-free surface of the base metal do not occur. Flaking-off of particles of the protective coating is also avoided.

Advantageously, a uniformly stable and protective oxide coating is formed at the grain surface when using such structural components in an oxidizing hot gas flow, for example, in turbines by the alloying composition which remains the same in the grain volume. Since the grain boundaries of this coating have fewer grain boundary precipitants than the base metal, the grain boundary corrosion is advantageously reduced.

The corrosion attack which prefers to occur at the grain boundaries and the susceptibility to cracking connected therewith, are impeded by the substantially more fine grained structure compared to the base metal, since advantageously large surfaced corrosion marks cannot form themselves.

These advantages together contribute to reducing the thermal fatigue of structural components protected as taught herein. The present teachings improve the corrosion resistance and the oxidation resistance.

The identity of the coating material with the base metal leads to the fact that thermal expansion differences do not occur between the coating and the base metal so that no thermal stresses are being induced. Thus, it is advantageous not to limit the coating thickness to less than 100 μm. Preferably, the base metal and the coating material are composed of the following elements:

| | |
|---|---|
| 13 to 17 | wt. % Co |
| 8 to 11 | wt. % Cr |
| 5 to 6 | wt. % Al |
| 4.5 to 5 | wt. % Ti |
| 2 to 4 | wt. % Mo |
| 0.7 to 1.2 | wt. % V |
| 0.15 to 0.2 | wt. % C |
| 0.01 to 0.02 | wt. % B |
| 0.03 to 0.09 | wt. % Zr |
| Remainder | Ni. |

This super alloy is traded under the name IN 100 so that the base metal and the coating material are available cost effectively.

DETAILED DESCRIPTION OF PREFERRED EXAMPLE EMBODIMENTS AND OF THE BEST MODE OF THE INVENTION

The finer the protective grain of the coating is structured, the more uniform appears the composition of the grain volume and the more perfectly a stable, uniform oxide layer of chromium and/or aluminum oxides is being formed in operation. Thus, according to the invention the grain volume or grain size of the protective coating is preferably smaller by at least $10^3$ times than the grain volume of the base metal. The grain boundaries of the preferred base metal IN 100 comprise titanium and vanadium containing grain boundary precipitants which form non-stable or low melting oxides. The coating therefore has preferably fewer precipitants at the grain boundaries than the base metal which advantageously improves the oxidation resistance and the corrosion resistance.

An especially preferred formation of the protective coating resides in that the protective coating is a plasma spray layer which advantageously crystallizes with utmost fine grains and few precipitants due to the high solidification speed.

The invention further has for its object to provide a method for producing a component with a protective coating as taught herein by performing the following process steps:

a) surface preparation by removal of the surface of the base metal for improving the bonding, b) coating of the base metal by means of plasma spray with plasma spraying material having the chemical composition of the base metal, c) epitaxial recrystallization by means of solution annealing at temperatures between 1150° and 1250° C., and d) after treatment of the surface of the protective coating by mechanical densification for smoothing and strengthening the surface and/or diffusion coating for increasing the oxidation resistance.

This method has the advantage that it is suitable for mass production.

Where the quality of the coating must satisfy high requirements, the surface preparation is performed by a plasma edging with an argon plasma. This preparation has the advantage that it is free of contaminations and that it is compatible with a low compression plasma spraying process so that the surface preparation, as well as the coating of the base metal, can take place in one operational sequence for a structural component, whereby the quality is advantageously improved because it is not necessary to transfer the component to a further equipment and residence times in a normal atmosphere are obviated.

Where high economic requirements must be met, the surface preparation is performed by chemical removal so that advantageously a high throughput is achieved.

An abrasive shot blasting is preferably applied as a surface removal because with this method large surface structural components as, for example rotor disks, may be advantageously prepared for a subsequent coating.

The coating by means of plasma spraying of a plasma spraying material having the same chemical composition as the base metal, can be performed to meet high quality requirements by a low pressure plasma spraying method and for large components and/or high requirements with regard to the economy it may be performed by means of plasma spraying under a protective gas.

An optimal growth of the protective coating on the base metal is achieved by an epitaxial recrystallization at a solution annealing temperature between 1150° C. and 1250° C., whereby, the lowermost or interface layer of the fine grained coating in the transition zone between the base metal and the protective coating recrystallizes in the same crystal orientation as the large volume crystallites of the base metal at the coating boundary so that advantageously, an intensive intermeshing between the fine grained coating and the coarse grained base metal results which substantially increases the bonding strength compared to conventional different material coatings. Thereafter, the coated component can be cooled at 30° C./min. to 80° C./min. down to 1000° C. to 800° C. and a multi-stage aging heat treatment may be applied.

For cast structural components of super alloys on a nickel or cobalt basis preferably a two-stage aging for the formation of a suitable $\gamma/\gamma'$ texture has proven itself. The aging involves maintaining 1080° C. to 1120° C. for two to six hours, followed by maintaining 900° C. to 980° C. for ten to twenty hours, with an in-between cooling to 750° to 800° C. With such a heat treatment the characteristics of the base metal are regenerated which have been changed by the solution annealing. Further, the strength values of the coating are advantageously increased.

A mechanical after-treatment of the surface of the protective layer improves the hardness, preferably by a ball or shot blasting and serves for smoothing the surface. The smoothing of the surface may also take place by a compression flow lapping or a sliding grinding operation. These possibilities of an after-treatment may be applied in combination to provide a mechanical densification.

A diffusion coating as an after treatment of the surface as is used customarily for increasing the long duration oxidation resistance on the base metal of nickel or cobalt based super alloys, may advantageously take place on the fine grained coating. This feature has the advantage that deep diffusions which occur along the grain boundary precipitants of the base metal, do not occur in the fine-grained coating having fewer grain boundary precipitants. The diffusion zone in the fine-grained coating is thus advantageously doped more uniformly and homogenously, for example, with aluminum or chromium than is possible on the coarse crystalline base metal. The oxidation resistance is thereby improved, for example, by the chromium doping at temperatures up to 850° C. and causes simultaneously an improved corrosion resistance against sulfidization. The aluminum doping, for example, increases the oxidation resistance at temperatures up to 1250° C.

The following application example for a structural component and a method represent preferred embodiments of the invention.

EXAMPLE OF A STRUCTURAL COMPONENT

On the surface of a coarse crystalline turbine blade made of IN 100 as a base metal having the above given elemental composition. There is located a low pressure plasma layer of the same chemical composition having a $3\times10^3$ finer grain volume than the base metal. In a thermal fatigue test (at a testing temperature of 1050° C.) the coated structural component withstands a temperature-load-change-number three times higher than the uncoated base metal.

EXAMPLE OF A METHOD

The surface of the base metal of a coarse crystalline turbine blade made of IN 100 as the base metal having the above given elemental composition, is removed on average to an extent of 0.5 to 10 μm by means of argon plasma etching at a pressure of 2 kPa to 4 kPa.

Thereafter, the base metal is coated by means of plasma spraying with a plasma spraying material having the same chemical composition as the base metal and at a temperature of the base metal of 900° C., for 120 seconds.

After removal of the coated turbine blade from the plasma spraying equipment, an epitaxial recrystallization is performed in a high vacuum oven. For this purpose, the component is maintained at a solution annealing temperature of 1200° C. for 4 hours in said oven, and then cooled at a cooling rate of 60° C./min. down to 800° C.

For the regeneration of the strength characteristics of the base metal and for increasing the coating or bonding strength, a two-stage heat treatment is performed in a high vacuum at 1100° C. for four hours and at 950° C. for sixteen hours with an intermediate cooling down to 800° C. at a cooling rate of 60° C./min.

After the cooling down to room temperature, the surface of the structural component is smoothed and strengthened by a blasting treatment with zirconium oxide balls having a diameter of 0.5 mm to 1 mm.

Although the invention has been described with reference to specific example embodiments, it will be appreciated that it is intended to cover all modifications and equivalents within the scope of the appended claims.

What is claimed is:

1. The combination of a structural component made of a nickel or cobalt base metal composition having a first crystal orientation and a protective coating on a surface of said structural component, said protective coating consisting of a composition that is chemically exactly identical to said base metal composition of said structural component for protection against oxidation, corrosion, and thermal fatigue, wherein said exactly identical composition avoids diffusion at an interface between said structural component and said protective coating, wherein said base metal composition and said protective coating form a $\gamma/\gamma'$ texture, wherein said protective coating is at least one thousand times more fine-grained than said base metal composition, and wherein a lowermost interface portion of said fine-grained coating directly on said structural component has the same epitaxial crystal orientation as said first crystal orientation of large volume crystallites of said base metal composition.

2. The structural component of claim 1, wherein said protective coating exhibits fewer grain boundary precipitants and a more uniform alloy composition in its grain volume than said base metal composition.

3. The structural component of claim 1, wherein each of said base metal composition and said protective coating composition consists of:

| | |
|---|---|
| 13 to 17 | wt. % Co; |
| 8 to 11 | wt. % Cr; |
| 5 to 6 | wt. % Al; |
| 4.5 to 5 | wt. % Ti; |
| 2 to 4 | wt. % Mo; |
| 0.7 to 1.2 | wt. % V; |
| 0.15 to 0.2 | wt. % C; |
| 0.01 to 0.02 | wt. % B; |
| 0.03 to 0.09 | wt. % Zr; |
| remainder | Ni. |

4. The structural component of claim 1, wherein said protective coating has fewer vanadium or titanium precipitants at the grain boundaries than said base metal composition having the same vanadium or titanium content.

5. The structural component of claim 1, wherein said protective coating is a plasma sprayed layer.

6. A method for protecting a structural component made of a nickel or cobalt base metal composition having a first crystal orientation, with a protective coating, consisting of the following steps:

(a) applying a preliminary surface treatment to said structural component by removal of a surface layer from said structural component to form a coating surface for improving a bonding strength, (b) directly coating said coating surface of said structural component by means of plasma spraying with a plasma spray material having a chemical composition which is exactly identical to said base metal composition for forming said protective coating having a grain structure which is at least one thousand times more fine grained than said base metal composition, (c) solution annealing at temperatures between 1150° C. and 1250° C. for causing an epitaxial recrystallization in said protective coating so that a second crystal orientation in said protective coating is the same as said first crystal orientation in said base metal composition, and (d) aging said structural component with its protective coating by maintaining said structural component at a temperature within the range of 1080° C. to 1120° C. for two to six hours, cooling said structural component to a temperature within the range of 750° C. to 800° C., and then maintaining said structural component within a temperature range of 900° C. to 980° C., for ten to twenty hours for forming a $\gamma/\gamma'$ texture, wherein diffusion is avoided.

7. The method of claim 6, wherein said removal is performed by one of chemical etching, plasma etching, and abrasive blasting.

8. A method for protecting a structural component made of a nickel or cobalt base metal composition having a first crystal orientation, with a protective coating, comprising the following steps:

(a) applying a preliminary surface treatment to said structural component by removal of a surface layer from said structural component to form a coating surface for improving a bonding strength, (b) coating said coating surface of said structural component by means of plasma spraying with a plasma spraying with a plasma spray material having a chemical composition which is exactly identical to said base metal composition for forming said protective coating having a grain structure which is at least one thousand times more fine grained than said base metal composition, (c) solution annealing at temperatures between 1150° C. and 1250° C. for causing an epitaxial recrystallization in said protective coating so that a second crystal orientation in said protective coating is the same as said first crystal orientation in said base metal composition, (d) aging said structural component with its protective coating by maintaining said structural component at a temperature within the range of 1080° C. to 1120° C. for two to six hours, cooling said structural component to a temperature within the range of 750° C. to 800° C., and then maintaining said structural component within a temperature range of 900° C. to 980° C., for ten to twenty hours for forming a $\gamma/\gamma'$ texture, wherein diffusion is avoided, and (e) after-treating the surface of said protective coating by applying a diffusion coating selected form the group consisting of aluminum and chromium, to said protective coating.

9. The method of claim 8, wherein said after-treating further includes a mechanical densification.

10. The method of claim 9, wherein said mechanical densification is achieved by any one or more of shot-blasting, compression flow lapping, and slide grinding.

* * * * *

UNITED STATES PATENT AND TRADEMARK OFFICE

CERTIFICATE OF CORRECTION

PATENT NO. : 5,232,789

DATED : August 3, 1993

INVENTOR(S) : Albin Platz et al.

It is certified that error appears in the above-identified patent and that said Letters Patent is hereby corrected as shown below:

Column 7, line 7, delete "plasma spraying with a";

Column 8, line 12, replace "form" by --from--.

Signed and Sealed this

Tenth Day of May, 1994

Bruce Lehman

*Attest:*

BRUCE LEHMAN

*Attesting Officer*

*Commissioner of Patents and Trademarks*